United States Patent [19]

Primati et al.

[11] Patent Number: 4,553,343

[45] Date of Patent: Nov. 19, 1985

[54] AUTOMATIC IRONING PRESS

[75] Inventors: Marco Primati, Cinisello Balsamo; Leonardo Calderini, Monza, both of Italy

[73] Assignee: Stabilimento Industriale Srl, Monza, Italy

[21] Appl. No.: 626,717

[22] Filed: Jul. 2, 1984

[30] Foreign Application Priority Data

Jul. 13, 1983 [IT] Italy ..... 22046 A/83

[51] Int. Cl.[4] ..... D06F 71/04

[52] U.S. Cl. ..... 38/33; 38/38

[58] Field of Search ..... 38/27, 32, 33, 34, 35, 38/36, 38

[56] References Cited

U.S. PATENT DOCUMENTS

| | | | |
|---|---|---|---|
| 1,506,628 | 8/1924 | Geldhof . | |
| 1,629,091 | 5/1927 | Clisson . | |
| 1,646,872 | 10/1927 | Prouty . | |
| 1,683,897 | 9/1928 | Johnson . | |
| 1,823,469 | 9/1931 | Reeps . | |
| 1,870,935 | 8/1932 | Sutton . | |
| 1,873,299 | 8/1932 | Davis . | |
| 1,903,402 | 4/1933 | Locke | 38/34 |
| 1,904,858 | 4/1933 | Davis | 38/33 |
| 2,021,312 | 11/1935 | Kahn | 38/33 X |
| 2,051,739 | 8/1936 | Page . | |
| 2,443,573 | 6/1948 | Brundage | 38/35 X |
| 2,472,656 | 6/1949 | Forse | 38/27 |
| 2,495,641 | 1/1950 | Newell | 38/38 |
| 2,532,850 | 12/1950 | May . | |
| 3,027,663 | 4/1962 | Frahm et al. . | |
| 4,300,296 | 11/1981 | Hochstrasser et al. | 38/27 X |

FOREIGN PATENT DOCUMENTS

| | | | |
|---|---|---|---|
| 1254573 | 11/1967 | Fed. Rep. of Germany | 38/27 |
| 2418186 | 12/1976 | Fed. Rep. of Germany . | |
| 2605071 | 7/1977 | Fed. Rep. of Germany . | |
| 2477592 | 9/1981 | France . | |
| 576031 | 5/1976 | Switzerland . | |
| 594775 | 1/1978 | Switzerland . | |
| 608047 | 12/1978 | Switzerland . | |

*Primary Examiner*—Werner H. Schroeder
*Assistant Examiner*—Andrew M. Falik
*Attorney, Agent, or Firm*—Murray, Whisenhunt and Ferguson

[57] ABSTRACT

An automatic ironing press comprising a bedplate (2), a fixed ironing plate (3) fastened to said bedplate, a pressing arm (4) swingably mounted onto said bedplate (2), and an ironing plate (6), heated and pivotally mounted to the arm (4), wherein an assembly of toggle levers (13, 14, 16) cooperating with a toothed sector (7) driven by motor means, is provided. The toggle assembly is provided with spring means (18) and causes the arm (4) to be closed with a constant pressing force, independently from the thickness of the material undergoing the ironing operation.

8 Claims, 9 Drawing Figures

AUTOMATIC IRONING PRESS

The present invention relates to an automatic ironing press, particularly suitable to transmit to the material undergoing the ironing a constant pressure independently from the thicknes of the same material. The ironing presses are machines ideated to carry out, in a faster and rational manner, the ironing of fabrics, linen garments and other material in substitution for the more known flat-iron, both for domestic requirements and for the ironing departments of communities such as hotels, pensioner's homes etc. The conventional ironing presses are essentially formed by a bedplate having a ironing plane which is operatively stationary and an ironing movable arm. The latter is pivotally mounted to the bedplate body and it is thus free for the rotation with respect to the ironing plate between an opening position and a closing position, the latter being the operating one. At the fore end of said ironing arm an ironing plate is moreover mounted, it being suitably heated and adapted to be lowered and raised with respect to the ironing plane depending on the rotation displacements of the ironing arm. The operation of the latter is carried out, in the conventional machine of this type, in an essentially manual manner as for instance described in the French Application for Pat. No. 81.046.38.

Other ironing presses of conventional type are for example those disclosed in the Swiss Pat. No. 576032 and in the Swiss application No. 3385-75 wherein safety sistems are foreseen which cooperate with spring systems for the automatic opening of the press. In the Swiss Pat. No. 594775, there is furthermore described an ironing press provided with an ironing plane whch is pivotally mounted to the ironing movable arm so as to maintain a correct position on the ironing plane even in the case of a high thickness of the material to be ironed.

The ironing presses according to the above considered prior art are, as already stated, manually operated: the intensity of the pressure applied to the fabrics undergoing the ironing is consequently irregular and, for materials of relevant thickness, it is sometimes insufficient. In the case of the ironing of the items of relevant thickness, the applied pressure, by using the conventional ironing machines, is in fact different from that provided during the ironing for instance of bed sheets and of other relatively thin items. It takes place, from one side, owing to the greater resistance offered by the fibers of the material of relevant thickness and, from the other side, owing to the fact that the greater spacing between the ironing plane and the ironing plate (corresponding to the thickness of the interposed material) varies the applied force. There exists consequently the need of providing a completely automatic ironing press, namely able to carry out by itself the whole ironing cycle, and which is able to apply in autonomous form to the items to be ironed a regular and constant pressure independently from the thickness of these items.

Of course in an automatic ironing press the safety problems, and particularly that of the damaging of the material being ironed owing to an excessive temperature of the ironing plates and/or to an extended staying of the material to be ironed in contact with the ironing plates, are of even greater importance with respect to the manual presses according to the known prior art.

The purpose of the invention is consequently that of providing ironing press which permit the cited problems to be overcome and the conventional apparatus of this type to be improved. Those and other purposes are achieved by means of the automatic press of the present invention, of the type comprising:

- a bedplate;
- an ironing plane fastened to said bedplate;
- a pressing arm mounted onto said bedplate so as to rotate between an opened or raised position with respect to the ironing plane and a closed or thereupon superimposed position;
- an ironing plate pivotally fastened to the free end of the pressing arm;
- means for the controlled heating of the material undergoing the ironing; characterized by comprising:
- driving means adapted to control the rotating motion of said pressing arm between the two said positions;
- sensing means for the control of the operation of said driving means; and
- motion transmitting means from said driving means to said arm, cooperating with elastic means combined with same arm and which are loaded when the latter takes said closed position so as to apply to said ironing plate a predetermined closing force against said ironing plane.

According to further features of the invention said motion transmitting means consist of a lever assembly of the toggle type.

Said lever assembly of the ironing press of the invention essentially comprises:

- a first and a second connecting rods pivoted to each other to form said toggle joint, the central hinged joint of which consists of a movable pin and is adapted to operated said sensing means, the free end of said first connecting rod being pivotally connected to a guide means for moving said free end of said first connecting rod along a predetermined pathway, said guide means being operated by said driving means, and the free end of said second connecting rod being pivoted to the free end of said pressing arm, and elastic drawing means connected between said pin and means coupled to the said guide means.

According to one embodiment of the ironing press according to the invention said guide means comprise a toothed sector, the rotation of which around a pivoting axis with respect to the press bedplate is controlled by means of a gear engaged with the teeth of the toothed sector, said gear being in turn driven into rotation by said driving means; said toothed sector is provided with a shaped slot in which said pin forming the central hinged joint of the toggle joint is freely housed and said free end of said connecting rod is pivoted to said sector in an eccentric position with respect of the rotation axis of said sector, said elastic means consisting of a drawing spring having a first end fastened to said pin or hinged joint and the other end anchored to said sector in a point selected as a function of the force which said spring, upon being loaded, must apply to said hinged jointand thus, at the very end, to the said ironing plate.

A characterising feature of the present invention thus consists in the fact that the ironing force needed for the ironing is exclusively applied to the hinged joint of the toggle mechanism controlling the opening and closing movements of the press. According to the invention there are furthermore foreseen safety devices adapted to control the opening or the raising of the ironing plate in the case of over heating or of interruption of the feeding electrical current of the said control sensing means.

With respect to the conventional ironing presses, the invention essentially offers the following advantages:

- the whole ironing cycle is automatically carried out, the movable arm being controlledly closed and being opened when the ironing operation is terminated.
- the material to be ironed is subjected to a constant pressure independently from his thickness;
- in the case of interruption of the electrical current feeding the control and safety systems, the ironing arm is automatically inactivated, it being raised so as to prevent the residual heat remaining in the ironing plane from damaging the material.

Preferred embodiments of the the ironing press of the invention are illustrated, only for exemplifying and not for limiting purpose, in the enclosed drawings to which the following description relates.

Figure 1:
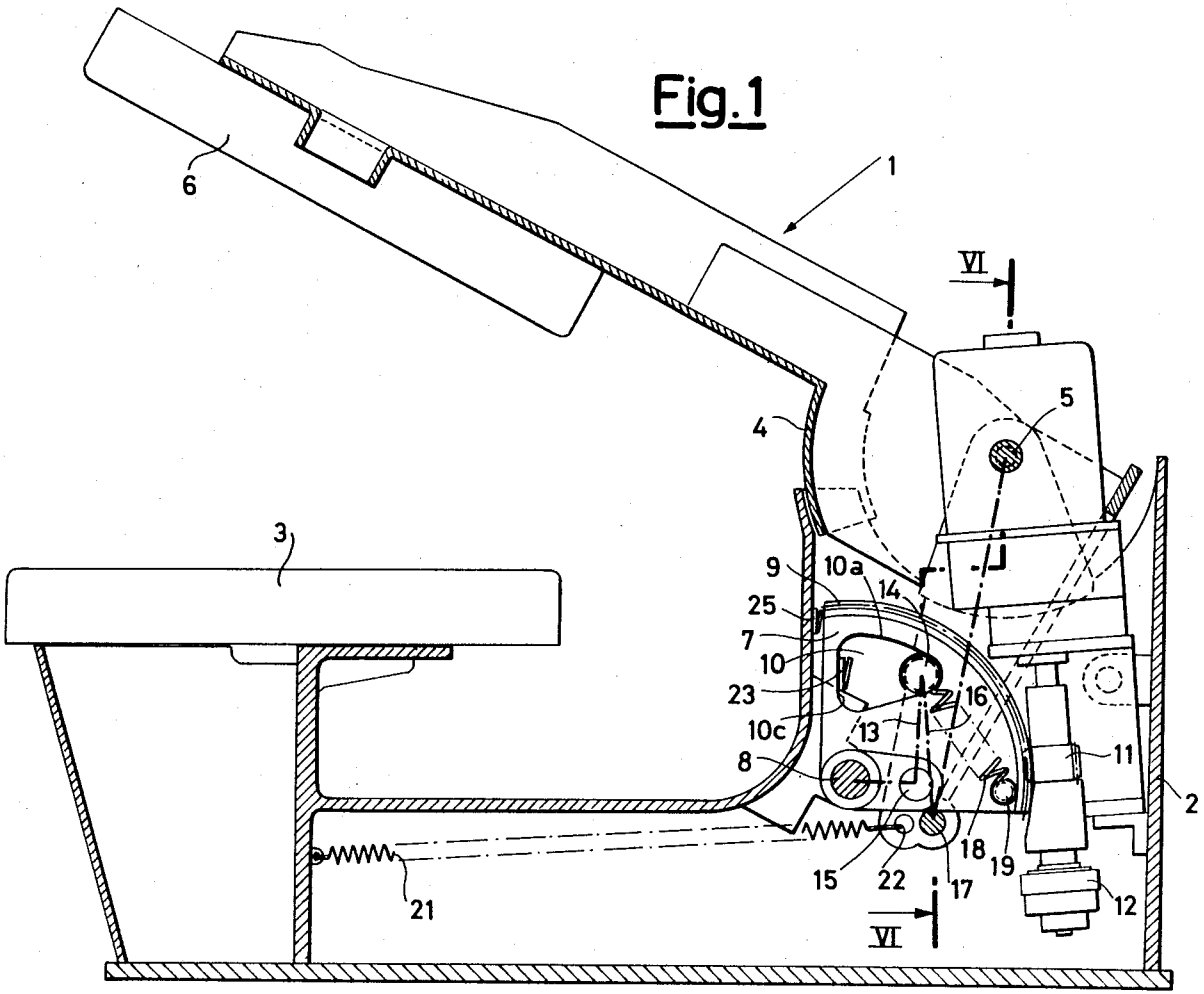
FIG. 1 is a cross-section view of a first embodiment of the press of the invention in an opened or non operative position.
Figure 2:
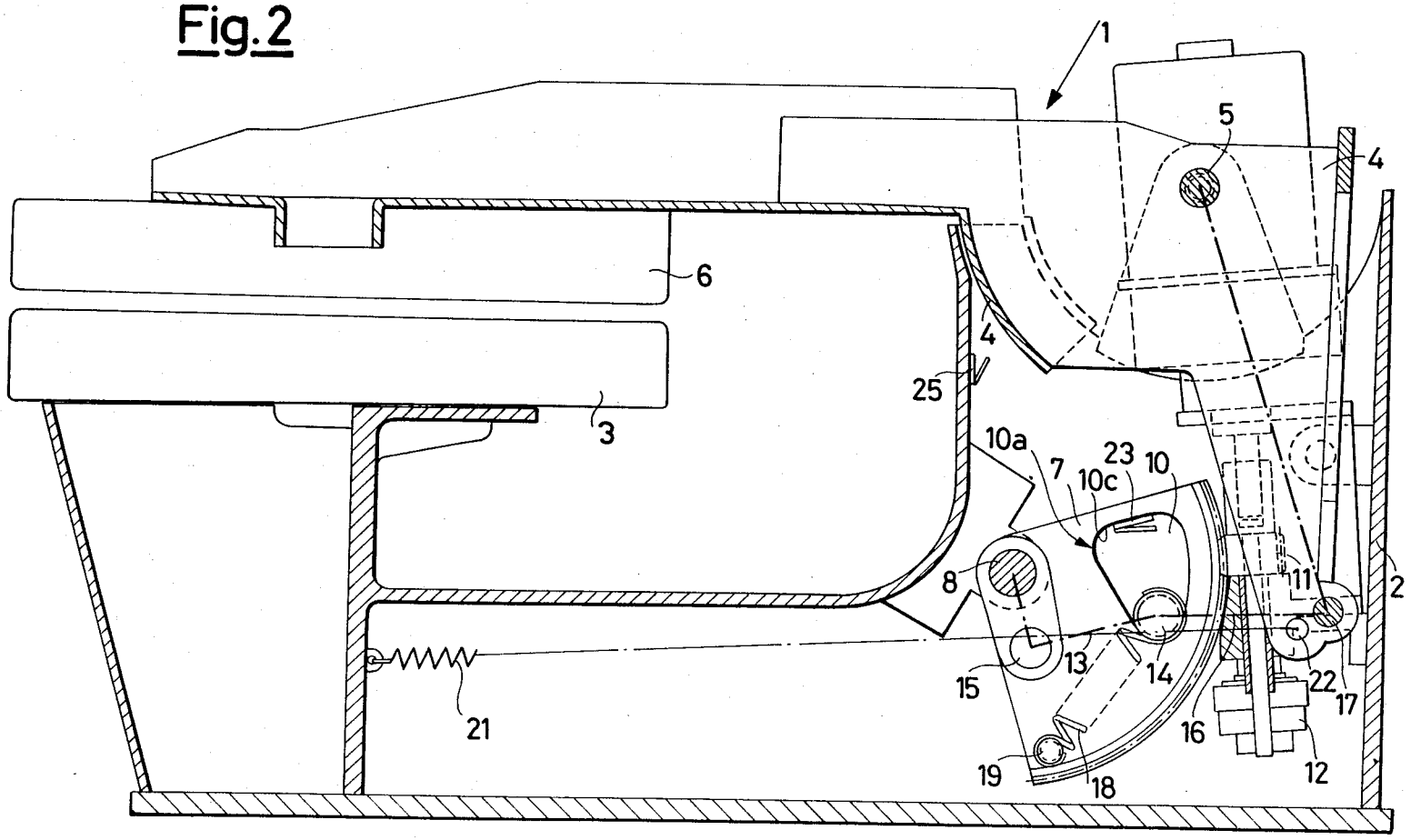
FIG. 2 shows the press of FIG. 1 in a closed position abutting against a material of small thickness positioned onto the ironing plane.
Figure 4:
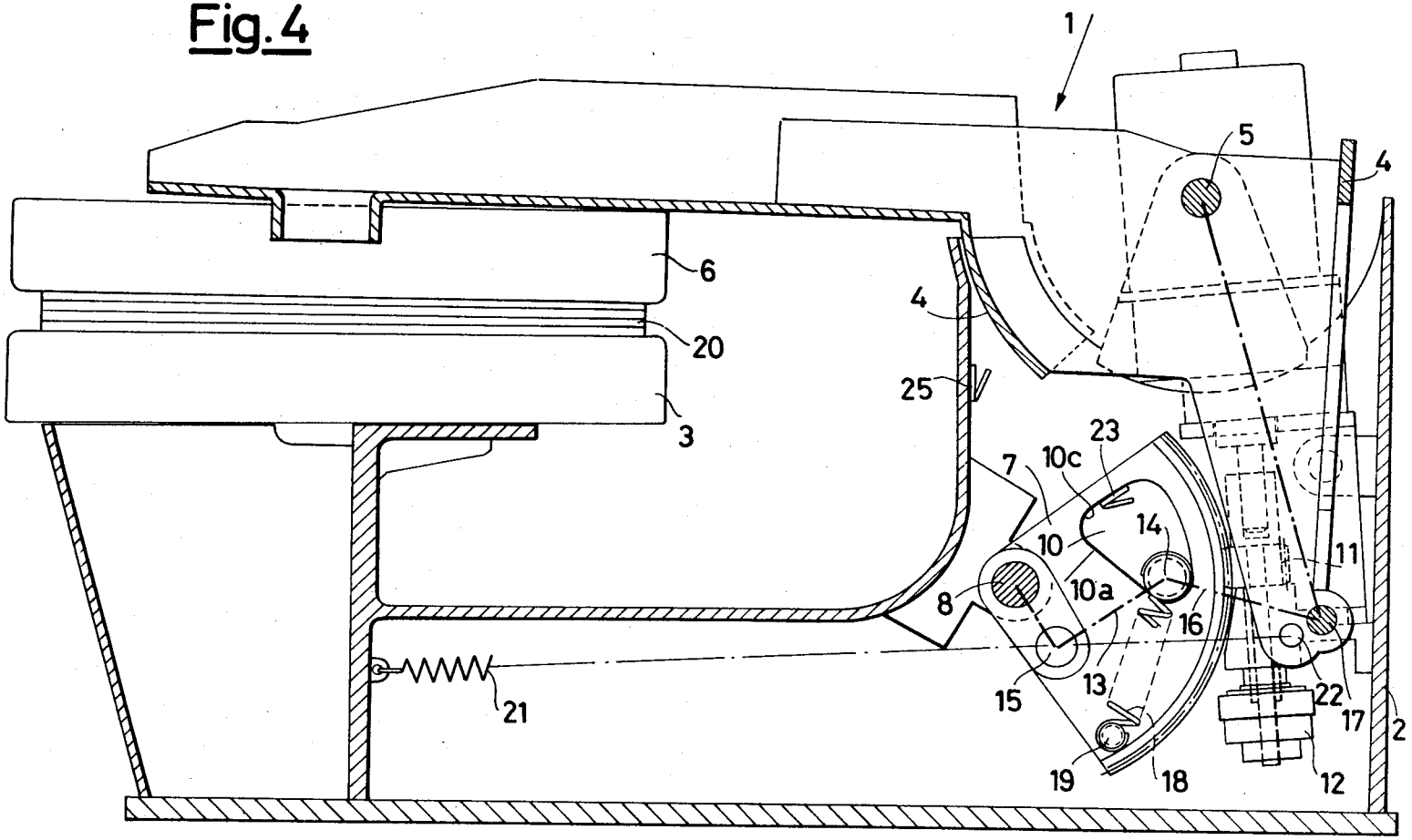
Figure 5:
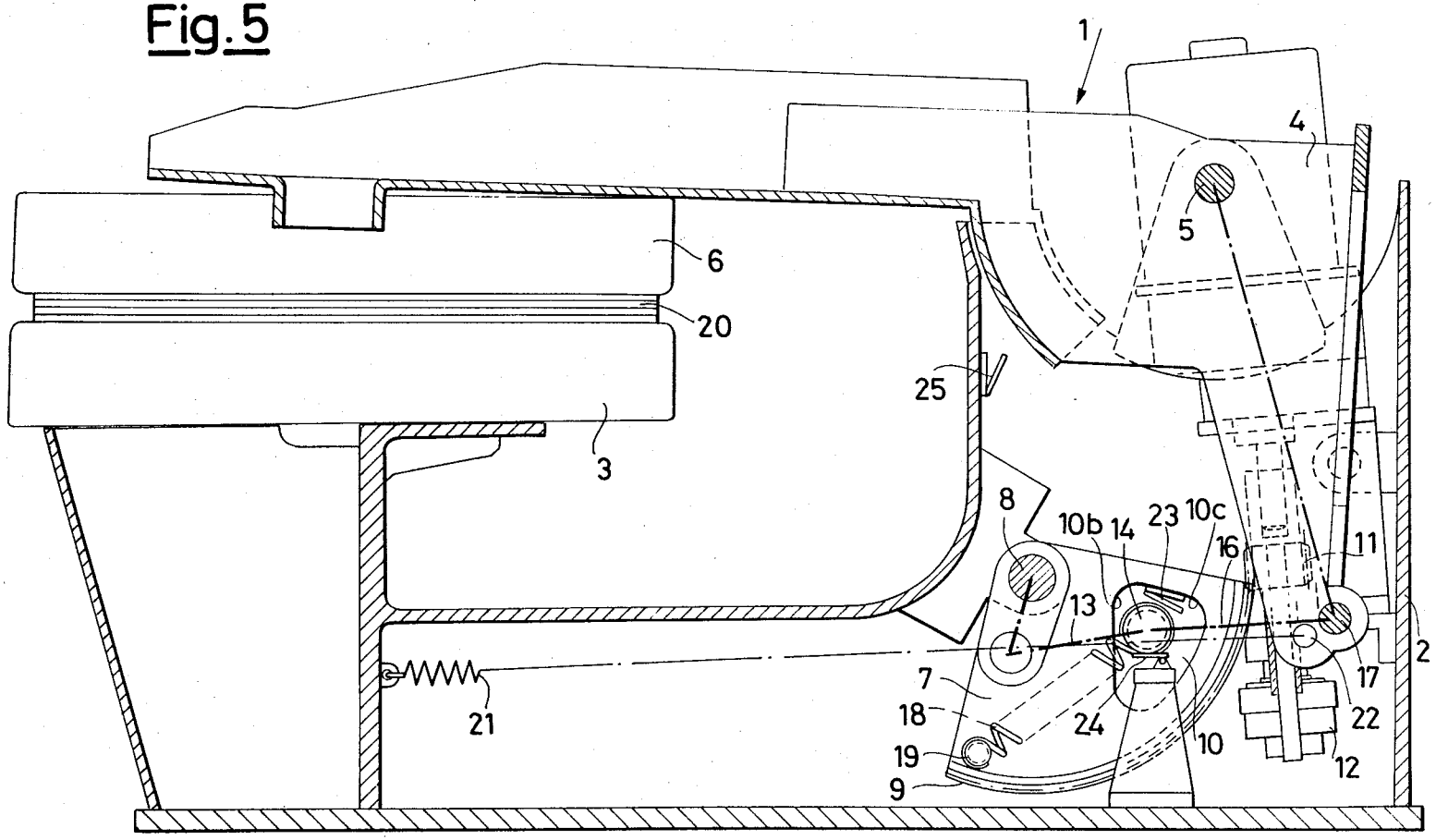
Figure 6:
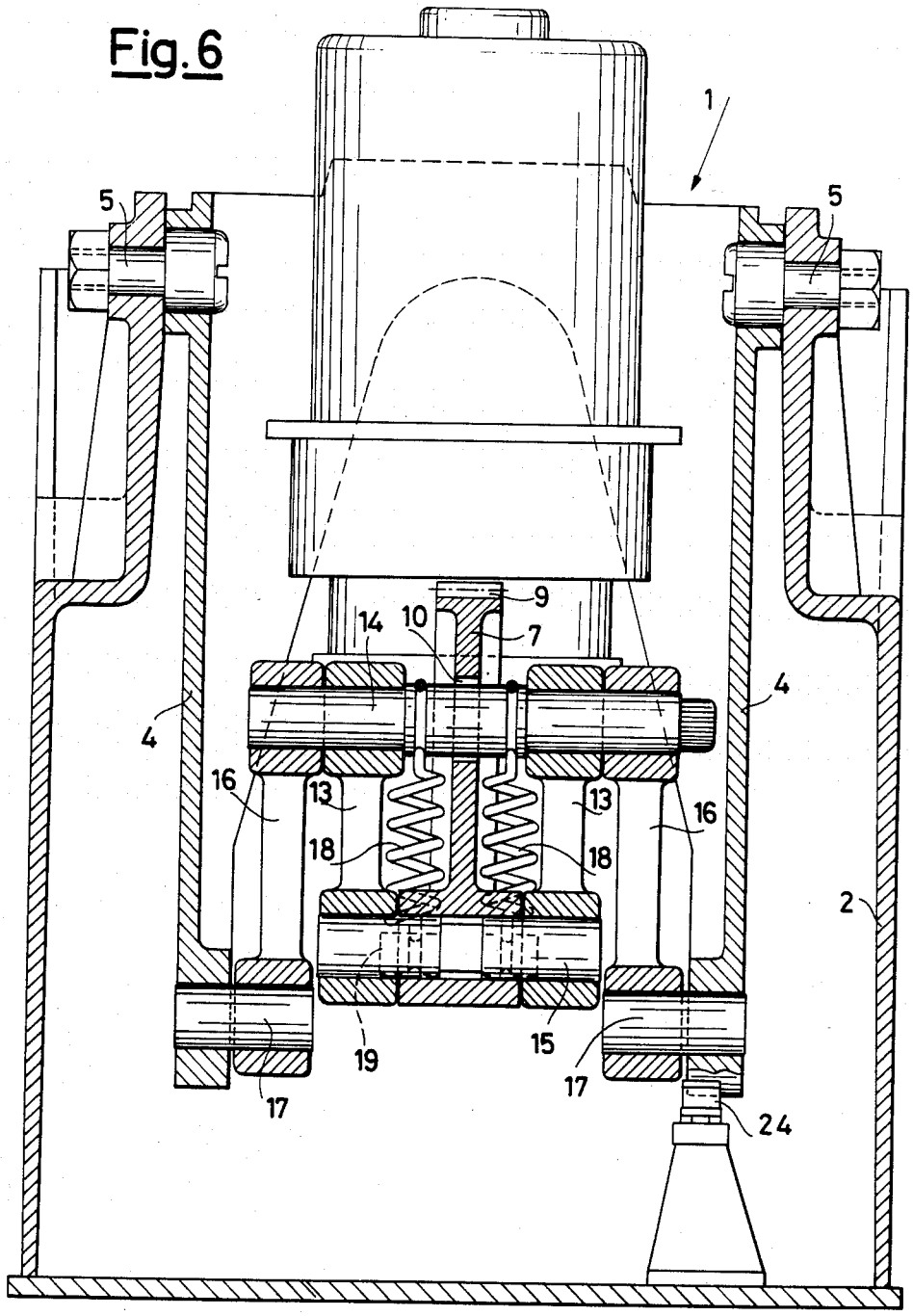
Figure 7:
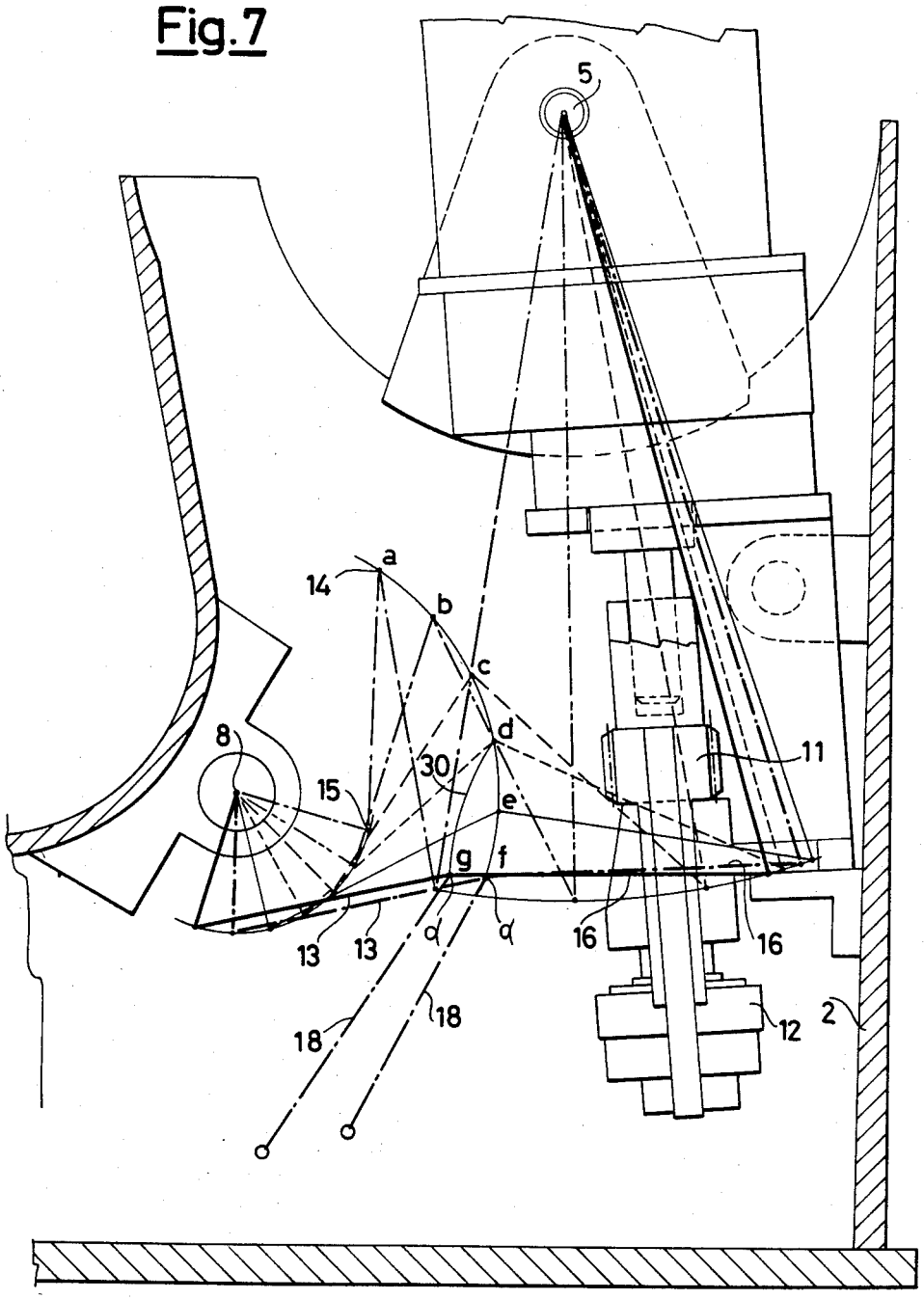
Figure 8:
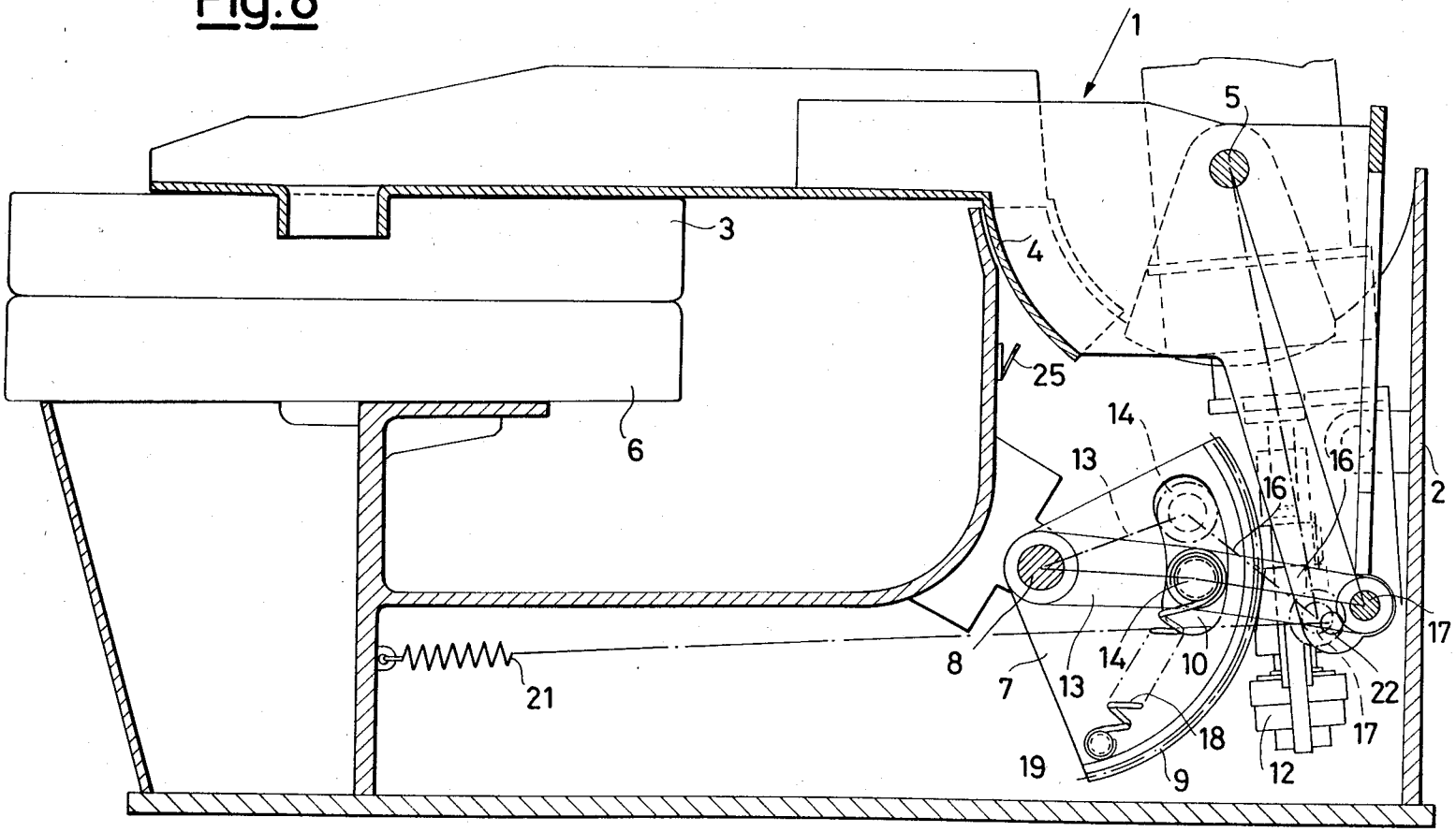
Figure 9:
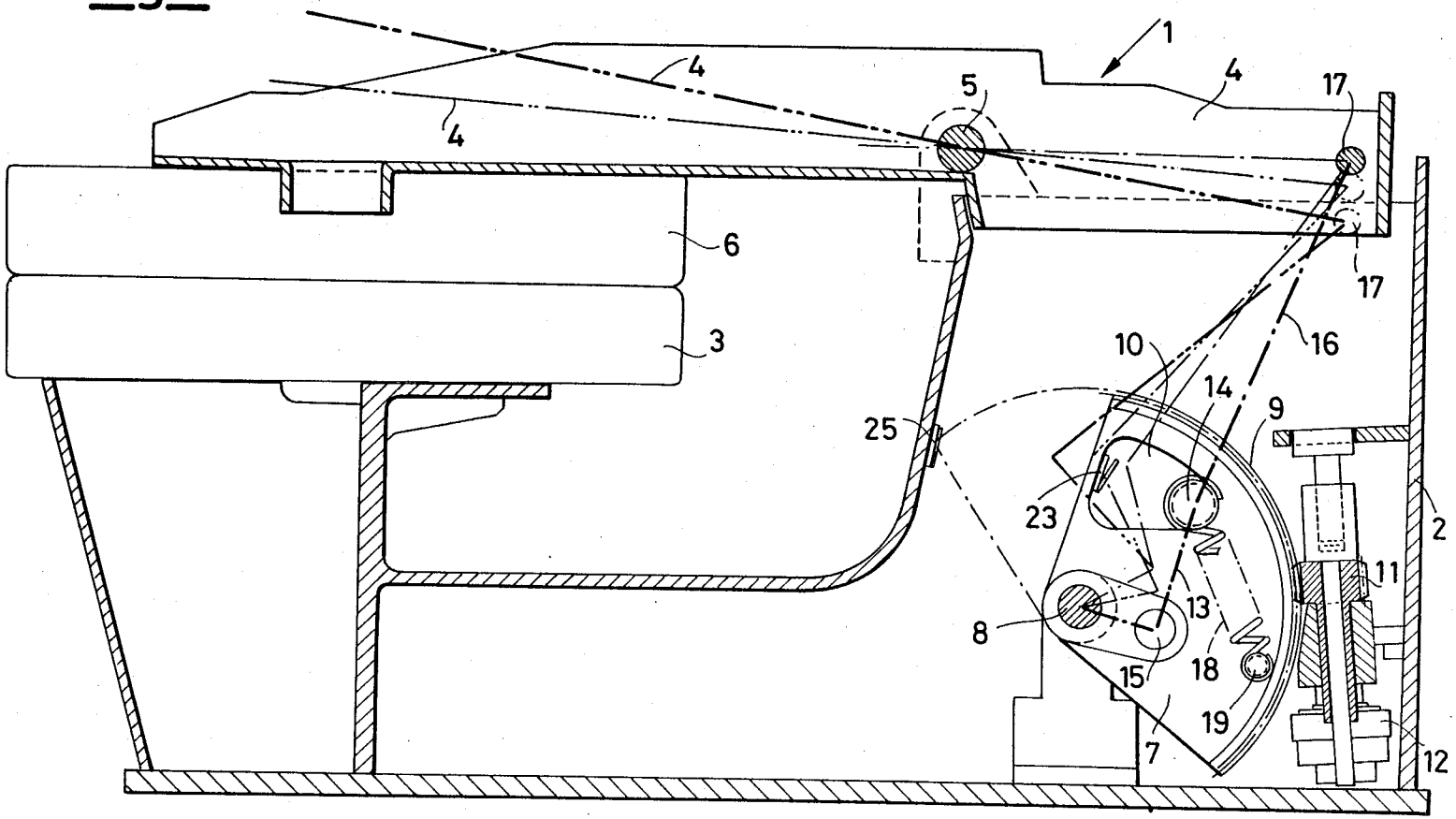

FIG. 4 corresponds to FIG. 2 and illustrates the press of FIG. 1 in a closed position with a material of great thickness abutted against the ironing plane;

FIG. 5 illustrates the press of FIG. 4 in pressing phase for the ironing of the material of great thickness;

FIG. 6 illustrates the press of FIG. 1 as a cross-section according to the line VI—VI of FIG. 1;

FIG. 7 illustrts the muvement pathway in sequence of the toggle joint of the press of FIG. 1;

FIG. 8 illustrates a different embodiment of the ironing press of the invention; and FIG.9 shows a further embodiment of the press of the invention.

With reference to FIG. 1, the automatic ironing press of the invention is on the whole indicated with reference 1 and comprises a bedplate 2 supporting a fixed ironing plate 3. The latter of course may be slipped of and/or replaceable, it being meant that it is operatively stationary. A rigid ironing arm is pivotally mounted at 5 to the bedplate 2, it being essentially shaped at right angles. The arm 4 has mounted thereto an ironing plate 6, heated by means of suitable means which are per se known, said plate 6 being mounted to the ironing arm 4 in a balancing manner so as to permit the plate to take a parallel position with respect to the fixed ironing plate 3, independently from the position of the pressing arm 4. The bedplate 2 has furthermore pivotally fastened thereto at 8 a sector 7, having a toothed edge 9 and an opening or shaped slot 10. An operating pinion 11, engaged with the toothed edge 9 of the sector 7, is connected to an electric ratiomotor driving groups (not shown) through an electromagnetic clutch 12. The motion transmission from the sector 7-pinion 11 assembly to the ironing arm 4 is carried out by means of a toggle mechanism consisting of:

- a first pair of connecting rods 13 fulcromed at a first end to a pin 14 movably housed in the slot 10 of the sector 7 and at the other end pivotally connected at 15 to the said sector 7, the connecting rods 13 being thus eccentric with respect to the latter;
- a second pair of connecting rods 16 pivotally mounted at one end to the same pin 14, which therefore represents the hinge of the hinged joint of the toggle mechanism, and at the other end to the corresponding end 17 of the pressing arm 4.

It is to be noted that in this embodiment pairs of connecting rods are foreseen which are parallel for each side of the toggle joint for reasons of structural strength.

The relative dimensions of the connecting rods 13, 16 and of the eccentricity between the rotation points 8 and 15, respectively, of the sector 7 and of the connecting rods 13, are such that in the opened position of the press shown in FIG. 1 the pin 14 abuts onto the fore portion 10*a* (according to the FIGS. 1 and 2) of the slot 10 of the sector 7. The pin 14, protruding with the ends from the two sides of the sector 7 (FIGS. 6), is furthermore connected at 19 by means of a pair of traction springs 18 to the sector 7.

In the position of FIG. 1, the springs 18 are essentially at rest, namely unloaded, except for a slight pre-load serving to maintain the pin 14 in the aforesaid position. As it is seen in FIG. 1, the slot 10 broadens starting from the fore edge 10*a* (FIG. 2) up to the rear edge 10*c*, at which a microswitch 23 is provided having the hereinafter explained function.

The press moreover comprises to further cycle microswitches 24 and 25 (see FIG. 5) respectively controlling the maximum opening of the toggle joint and the maximum opening of the plate. By actuating a switch (not shown) provided on the body of the press, the lowering of the arm 4 (and consequently of the plate 6); as controlled the heating means of the plate 6 are activated through a different control mechanism. For such a lowering the said ratiomotor group is actuated which in turn actuates the pinion 11 causing the rotation (clockwise in FIG. 1) of the sector 7 around the pin 8. During this rotation, the toggle mechanism 13, 14, 16 is opened or extended causing the lowering of the fore end of the arm 4 through the rotation of the latter around the pin 5. The sequence of movements of the toggle joint and particularly of the pin 14 is indicated by the references from a to d in FIG. 7. In the case that onto the ironing plane 3 a fabric of small thickness is placed, the rotation of the arm 4 is continued to the position shown in FIG. 2 and corresponding to the point e of FIG. 7, in which the pin 14 still adheres to the inner edge 10*a* of the slot 10 of the sector 7 as in the starting position (FIG. 1), and the end 17 of the connecting rod 16 (or of the pressing arm 4) has achieved the maximum extension point.

Figure 3:
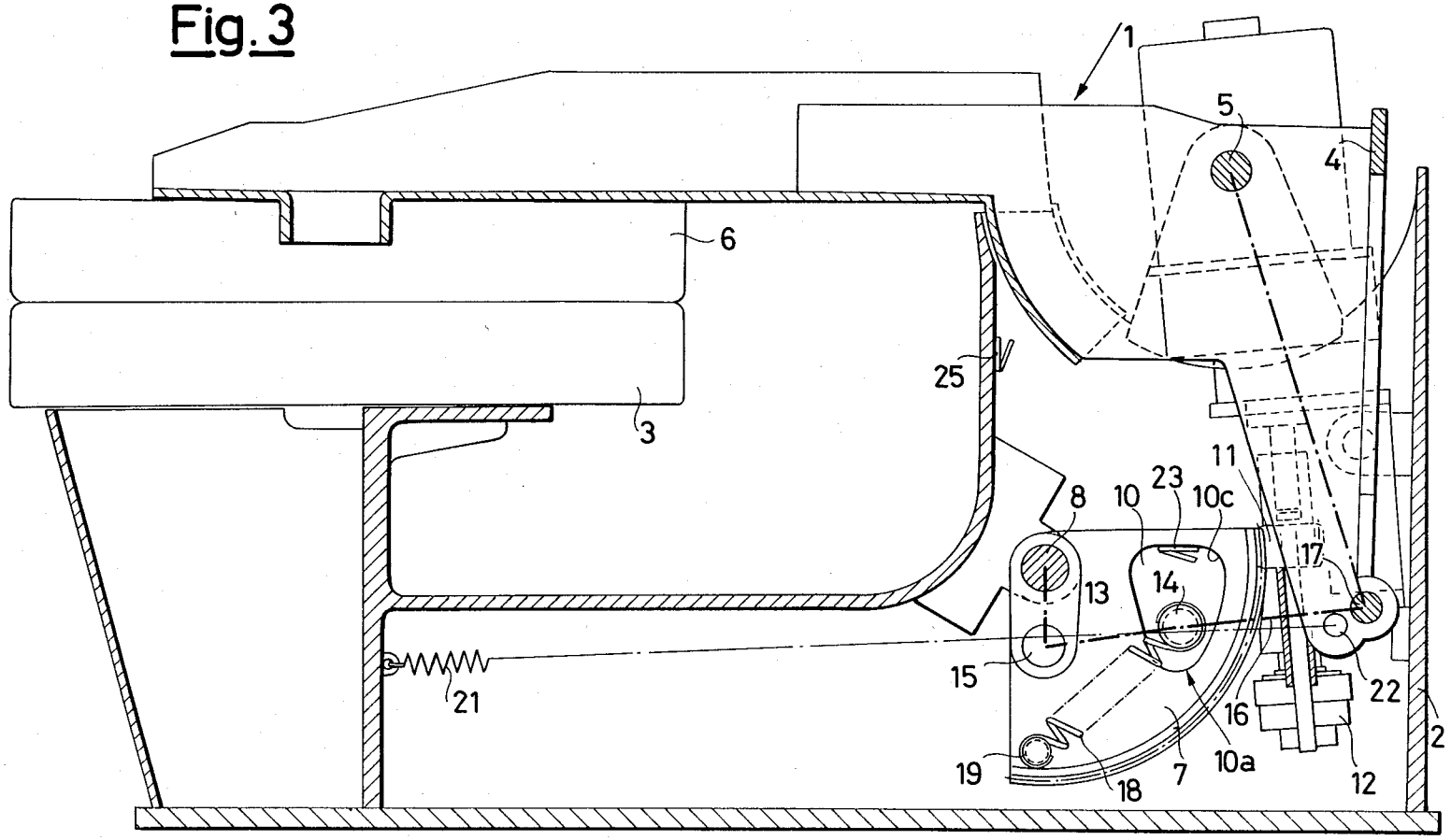
FIG. 3 illustrates the press of FIG. 2 in the phase of pressing or ironing of the material of small thickness.

Starting from this moment the compression phase illustrated in FIG. 3, begins which is obtained by means of a further rotation of the sector 7 by a certain angle in which, the point 17 being now in a fixed position of end of stroke, the pin 14 has been removed by a certain length from the inner edge 10*a* of the slot 10; the actuation of a limit device, as individuated by a microswitch 24 (FIG. 6), controlling the stopping of the ratiomotor group takes place when the further displacement of the sector 7 has occurred in the desired amount, the microswitch 24 being possibly actuated by the pin 14.

In this position of the sector 7 (point f of FIG. 7), the spring 18 is loaded (extended) and transmits a load onto the hinge 14 and thus onto the end 17 of the arm 4, consequently pressing the ironing plate 6 against the ironing plane 3, corresponding to the component directed along the connecting rod 16. It is thus seen that by varying the position of the attachment point 19 of the spring 18 to the sector 7 it is possible to vary the intensity of the closing force of the ironing plate against the ironing plane. Like results can be obtained by varying the elasticity of the spring.

From the FIGS. 3 and 7 it is observed that in the phase of pressing or ironing, the opening of the toggle joint is equal to a certain maximum angle alpha which is at the very end determined from the position of the microswitch 24. In the case in which onto the ironing plane 3 an item 20 is placed having a relevant thickness (FIG. 4) starting always from the position of FIG. 1, the closing movement of the plate 6 will be at a certain point stopped from the body 20 which prevents the relative position of the plates 3,6 illustrated in FIG. 2, from being achieved; the position which is attained in such a case is, as already stated, that illustrated in FIG. 4 in which the toggle joint 13, 14, 16 has been freely opened by a certain angle lower than the angle alpha and the pin 14 is still into contact with the slot 10.

Assuming for instance that the position of the pin 14 in FIG. 4 corresponds to the point d of FIG. 7, and upon the clockwise rotation of the sector 7, the pivoting point 17 remains stationary (since the arm 4 cannot further rotate around the pin 5) and the opening of the toggle mecanism up to the alpha angle, previously indicated with reference to the case of a small thickness (FIG. 3), takes only place by displacement of the pivoting points 14 and 15. During such rotation of the sector 7 from the said position d, the pin 14 does substantially follow the edge 10*b* (FIG. 5) of the slot 10 whereby the pin 14 follows the pathway 30 indicated in FIG. 7.

When the alpha opening angle between the connecting rods 13 and 16 (point g of FIG. 7) is achieved the pin 14 is removed from the edge 10*b* of the slot 10 (FIG. 5). The stopping of the driving ratiomotor group and thus of the sector 7 is controlled also in that case from the microswitch 24. In the said position of FIG. 5, although the spring 18 is differently loaded with respect to the case of FIG. 3, the loading component acting on the pin 14 (and thus on the ironing plane) remains constant with respect to the previous case of ironing of thin material (FIG. 3) and the alpha angle in both cases remains unchanged. As a matter of fact the loading component transmitted from the sping 18 to the arm 4 directly depends on the alpha angle of opening of the toggle joint, and thus the arm 4 is loaded, in the position of pressing of thick material (FIG. 5), with a force equal to pressing force of a thin fabric (FIG. 3). Such a final result is obtained, according to the invention, independently from the thickness of the material 20.

It is furthermore observed that, mainly in the case of soft and thick material, also during the pressing phase, the end 17 of the arm 4 undergoes acertain displacement; in any case the opening of the toggle joint achieves the alpha constant angle, namely the pressing arm is loaded with a costant final force. In the case in which the thickness of material interposed between the ironing planes is higher than a predetermined value, at the closing of the pressing arm 4 the pin 14 will be compelled to be displaced in the slot 10 towards the rear edge 10*c*, thus actuating the microswitch 23, which stops the operation of the driving ratiomotor group and controls the carring out of the ironing operation. At the end of the ironing cicle, the press is opened again and the opposite rotation of the pressing arm 4 stops when the microswitch 25 is actuated (FIGS. 1, 2) preferably correspondingly to the end of the return stroke of the sector 7. To restore the correct condition of parallelism between the ironing plane and plate also in the ironing of great thickness fabrics, said ironing plate is mounted in an articulated manner in a conventional way to the arm 4.

An adjustable timer is foreseen in the press of the invention to bring the pressing arm from the ironing position of the FIGS. 3 and 6 to that of FIG. 1, a further timer (not shown and of normal type) being foreseen as a safety device for the opening of the press after a maximum limit time. Such a return movement can be carried out either by inversion of the rotation of the driving ratiomotor group, and thus of the pinion 11, or by making use of a gear sistem which can be considered like a speed change mechanism of conventional type in the motorvehicles (not shown), in the case in which the motor has only one rotation direction.

The return of the press from the closed, ironing position to the rest, opened position is controlled also in the case in which a thermostat (not shown) positioned in a suitable place does reveal an excessive heating of the ironing plane 3. In all cases, the return of the arm 4 towards the opening position is helped especially in the initial pick-up from the spring 21 (FIG. 1) fastened from one side to the fore part of the bedplate 2 of the press and at the other side at the point 22 of the toggle mechanism foreseen at the pivotal joint 17 (FIG. 1).

A further safety device is foreseen to prevent a possible interruption of electrical tension from inactivating the sensing means controlling the raising of the arm 4; such an operation made be important to avoid a possible damaging of the material to be ironed owing to the residual heat of the plane 3. Such a safety device is essentially formed by the electromagnetic clutch 12 which in case of interruption of the feeding tension of the press, is disengaged and makes the pinion 11 (and thus the sector 7) free; under such conditions the spring 21 starts the already described return movement, thus causing the raising of the arm 4. In the embodiment of FIG. 8, the same reference numbers have been maintained for the parts like those of the embodiment of FIG. 1.

In this embodiment the connection rod 13 is centered onto the pin 8 of the sector 7 and the slot 10 takes the form of an elongated window of essentially arcuate shape so as to guide the movement of the hinged joint 14 during the rotation of the sector 7. In this embodiment the spring 18 is constantly loaded and carries out the dragging of the pin 14, whereas the pin 19 by which the spring is attached to the sector 7 has essentially the same function as the pin 15 of the embodiment of FIG. 1 as regards the position determining the movements of the arm 4. The difference with respect to the previous embodiment is that the action of the spring compensates the different opening of the ironing position of the toggle joint, whereby the force acting on the ironing plate shall be in this case too constant, thanks to the compensation effect of the spring. In this embodiment also the use of the safety device already considered for the embodiment of FIG. 1 is adopted.

In the embodiment of FIG. 9, in which like reference numbers indicate parts equal or corresponding to those of the preceding figures, the toggle mechanism, for easyness and simplification of assembling and of operation, is inserted in the essentially vertical part or upright of the bedplate 2, whereas the pressing arm 4 is essentially rectilineal and consists of a lever fulcrumed at an internal point thereof which is suitably selected.

According to a further embodiment the aforesaid sector 7 is not provided with a toothed part and the operation takes place by direct transmission from the driving means to the pivoting axis 8 of the sector 7. By suitably controlling the rotation of the aforesaid pivoting axis the operation as previously described is obtained.

Of course the above described and illustrated press can be further varied and modified without falling out of the scope of protection of the invention. Thus for instance instead of the cited driving ratiomotor group the operation of the sector 7 may take place by means of a manually controlled lever.

We claim:

1. An automatic ironing press comprising:

a bedplate;

a first ironing plate fastened to said bedplate;

a pressing arm, having a first end and a second end, mounted onto said bedplate so as to rotate said first end between an opened or raised position with respect to said first ironing plate and a closed or thereupon superimposed position;

a second ironing plate pivotally fastened to the first end of the pressing arm;

means for the controlled heating of the material undergoing the ironing;

driving means for supplying a driving force to move said pressing arm between the two positions of said first end;

sensing means for the control of the operation of said driving means; and force transmitting means for transmitting force from said driving means to said pressing arm to move said pressing arm between the two positions of said first end, said force transmitting means applying a predetermined closing force to said arm when said first end is in said closed position, said force transmitting means comprising first and second connecting rods pivoted to each other to form a toggle joint, said toggle joint including a moveable pin adapted to operate said sensing means, the free end of said first connecting rod being pivotally connected to a guide means for moving said free end of said first connecting rod along a predetermined pathway, said guide means being operably connected to said driving means, the free end of said second connecting rod being pivotally connected to the second end of said pressing arm, and spring means connected to said guide means for applying a force to said moveable pin.

2. The automatic ironing press according to claim 1, wherein said guide means comprises a toothed sector, the rotation of which around a pivoting axis with respect to the press bedplate is controlled by means of a gear being engaged with the teeth of the toothed sector, said gear being in turn driven into rotation by said driving means, said toothed sector provided with a shaped slot in which said moveable pin of said toggle joint is housed.

3. The automatic ironing press according to claim 2, wherein said free end of said first connecting rod is pivotally connected to said sector in an eccentric position with respect to the rotation axis of said sector, said spring means comprising a tension spring having a first end secured to said moveable pin and the other end anchored to said sector.

4. The automatic ironing press according to claim 2, further comprising an electromagnetic clutch connecting said driving means and said gear.

5. The automatic ironing press according to claim 4, further comprising a traction spring cooperating with said electromagnetic clutch to cause the opening or raising of the pressing arm in the case of interruption of the electric current feeding the press, said traction spring being mounted, under tension, between the second end of said pressing arm and a fore part of said bedplate.

6. The automatic ironing press according to claim 1, wherein said guide means comprises a plate or sector, the rotation of which around a pivoting axis with respect to the bedplate of the press is controlled by direct transmission of a driving force from the driving means to the pivoting axis of the sector, said sector provided with a shaped slot in which said moveable pin is housed.

7. The automatic ironing press according to claim 1, wherein said toggle is provided in a substantially vertical part or upright of the bedplate, said pressing arm consisting of a rectilinear lever fulcrumed at an intermediate point thereof to said upright.

8. The automatic ironing press according to claim 1, wherein said sensing means comprises limit microswitches, operated by said moveable pin and positioned so as to permit the opening of the toggle joint up to a predetermined angle $\alpha$ between said first and second connecting rods, independently of the closed position of the first end of said pressing arm.

* * * * *

UNITED STATES PATENT AND TRADEMARK OFFICE

CERTIFICATE OF CORRECTION

PATENT NO. : 4,553,343

DATED : November 19, 1985

INVENTOR(S) : Marco Primati, et al.

It is certified that error appears in the above-identified patent and that said Letters Patent is hereby corrected as shown below:

Title page:

In the line labelled "[73] Assignee:", delete "Stabilimento Industriale Srl, Monza, Italy" and insert --Stabilimento Industriale Singer Srl, Monza, Italy--.

Signed and Sealed this

*Twentieth* Day of *May 1986*

[SEAL]

*Attest:*

DONALD J. QUIGG

*Attesting Officer*

*Commissioner of Patents and Trademarks*